US007547389B2

(12) United States Patent
Mellegard et al.

(10) Patent No.: US 7,547,389 B2
(45) Date of Patent: Jun. 16, 2009

(54) BOTTOM SEAL

(75) Inventors: Per Mellegard, Skovde (SE); Stefan Naij, Asa (SE)

(73) Assignee: Mellegard & Naij AB, Skovde (SE)

( * ) Notice: Subject to any disclaimer, the term of this patent is extended or adjusted under 35 U.S.C. 154(b) by 0 days.

(21) Appl. No.: 10/593,074

(22) PCT Filed: Apr. 14, 2005

(86) PCT No.: PCT/SE2005/000533

§ 371 (c)(1),
(2), (4) Date: Apr. 26, 2007

(87) PCT Pub. No.: WO2005/103390

PCT Pub. Date: Nov. 3, 2005

(65) Prior Publication Data

US 2007/0209985 A1 Sep. 13, 2007

(30) Foreign Application Priority Data

Apr. 26, 2004 (SE) ..... 0401062

(51) Int. Cl.
*E02B 5/08* (2006.01)

(52) U.S. Cl. ..... 210/155; 210/158; 210/159; 210/389

(58) Field of Classification Search ..... 210/154, 210/155, 158, 159, 162, 357, 388, 389, 391
See application file for complete search history.

(56) References Cited

U.S. PATENT DOCUMENTS 1,773,576 A * 8/1930 Downes ..... 210/154
4,853,116 A * 8/1989 Wallander ..... 210/155
5,098,561 A * 3/1992 Grabbe ..... 210/155
5,456,826 A * 10/1995 Mellegard ..... 210/155
2004/0112810 A1 * 6/2004 Frommann ..... 210/155

FOREIGN PATENT DOCUMENTS

| | | | |
|---|---|---|---|
| EP | 0484724 | A2 | 5/1992 |
| SE | 461284 | B | 1/1990 |
| SE | 505169 | C2 | 7/1997 |
| WO | WO 9942668 | A1 | 8/1999 |

* cited by examiner

*Primary Examiner*—Christopher Upton
(74) *Attorney, Agent, or Firm*—Harness, Dickey & Pierce, P.L.C.

(57) ABSTRACT

A bottom seal, at the lower end of a step screen, is adapted to convey solid particles and other objects positioned in flowing water. The step screen has a grating including alternately fixed and movable lamellar rods with intermediate gaps to allow the water to pass through the grating. The bottom seal extends substantially across the entire width of the grating to seal the ducts that arise between the fixed lamellar rods at their lowermost step as the movable lamellar rods move upwards between the fixed lamellar rods. The bottom seal includes an elongate bottom cover, which at its longitudinal edge upstream is, via hinges, pivotally connected to the step screen via a bottom step upstream of the bottom cover. At its longitudinal edge downstream, the elongate bottom cover is guided on guides on the lowermost steps of the movable lamellar rods in order to follow the motion thereof and, in this motion, is pivotable up and down close to and past the edges upstream on the lowermost steps of the fixed lamellar rods.

19 Claims, 3 Drawing Sheets

BOTTOM SEAL

FIELD OF THE INVENTION

This invention relates to a bottom seal at the lower end of a step screen provided with a grating and adapted to convey solid particles and objects positioned in flowing water, said grating comprising alternately fixed and movable lamellar rods with intermediate gaps to allow the water to pass through the grating and with steps at their longitudinal edges upstream, the movable lamellar rods being movable in a closed motion path in their plane with an upwards component which is greater than the height of the steps, for step by step conveyance of the solid particles and the objects from the water and along the fixed lamellar rods to an outlet, the bottom seal extending substantially across the entire width of the grating to seal the ducts that arise between the fixed lamellar rods at their lowermost step as the movable lamellar rods move upwards between the fixed lamellar rods.

BACKGROUND ART

Step screens of the above type are known, for instance, from SE-B 461,284 and are commonly used to separate solid particles and other objects from municipal and industrial wastewater.

The fixed and movable lamellar rods have usually a thickness in the order of 2 to 6 mm, while the intermediate gaps between the fixed and movable lamellar rods to allow the flowing water to pass can normally amount to between 1 and 6 mm. In operation, as the movable lamellar rods move upwards between the fixed lamellar rods, ducts will be formed between the fixed lamellar rods at their lowermost step, the width of the ducts substantially corresponding to the thickness of the respective movable lamellar rods and twice the gap size, i.e. from about 4 to about 18 mm.

Through these ducts, correspondingly large particles and objects can pass more or less unimpededly owing to the relatively high speed of the flowing water and be entrained the flowing water. As a result, the water will not be sufficiently screened, thus requiring additional screening and/or causing problems in the subsequent treatment of the water.

Alternatively, excessively large particles and objects get stuck in the ducts and are hit by the lower edges of the movable lamellar rods when these movable lamellar rods after the upward motion again move downwards between the fixed lamellar rods and restore normal gap sizes. Consequently, the lower ends of the movable lamellar rods can be damaged, and finally the entire step screen may stop functioning.

FIG. 7 in the above-mentioned SE B 461,284 shows an attempt to reduce the above-described problems by a design where a covering member in the form of a plate is articulated with its one, first end to the lowermost steps of the movable lamellar rods and is designed to extend with its opposite, second end towards the bottom of a gutter for the flowing water, preferably to slide towards the bottom of the gutter as the lamellar rods move.

However, this design does not solve the problems above since the plate certainly covers the edges upstream on the lowermost step of the fixed lamellar rods but not the upper side of these steps, when the movable lamellar rods move from their lower to their upper position in their closed, circular motion path. On the upper side of the lowermost steps of the fixed lamellar rods, the above-described ducts are positioned, through which solid particles and other objects can pass or in which they get stuck, with the ensuing problems as described.

OBJECT OF THE INVENTION

The object of the invention is to provide a bottom seal, which in a simple and effective manner seals all ducts both from the front (upstream) and from above between the fixed lamellar rods at their lowermost step during the motion of the movable lamellar rods between the fixed ones.

SUMMARY OF THE INVENTION

According to the invention, this object is achieved by the bottom seal comprising at least one elongate bottom cover, which at its longitudinal edge upstream is connected to the step screen and at its longitudinal edge downstream on the one hand is guided on guides on the lowermost steps of the movable lamellar rods in order to follow the motion thereof and, on the other hand, in this motion is pivotable up and down close to and past the edges upstream on the lowermost steps of the fixed lamellar rods.

BRIEF DESCRIPTION OF THE DRAWINGS

The invention will in the following be described in more detail with reference to the accompanying drawings, which illustrate a currently preferred embodiment there-of.

DESCRIPTION OF A PREFERRED EMBODIMENT

Figure 1A:
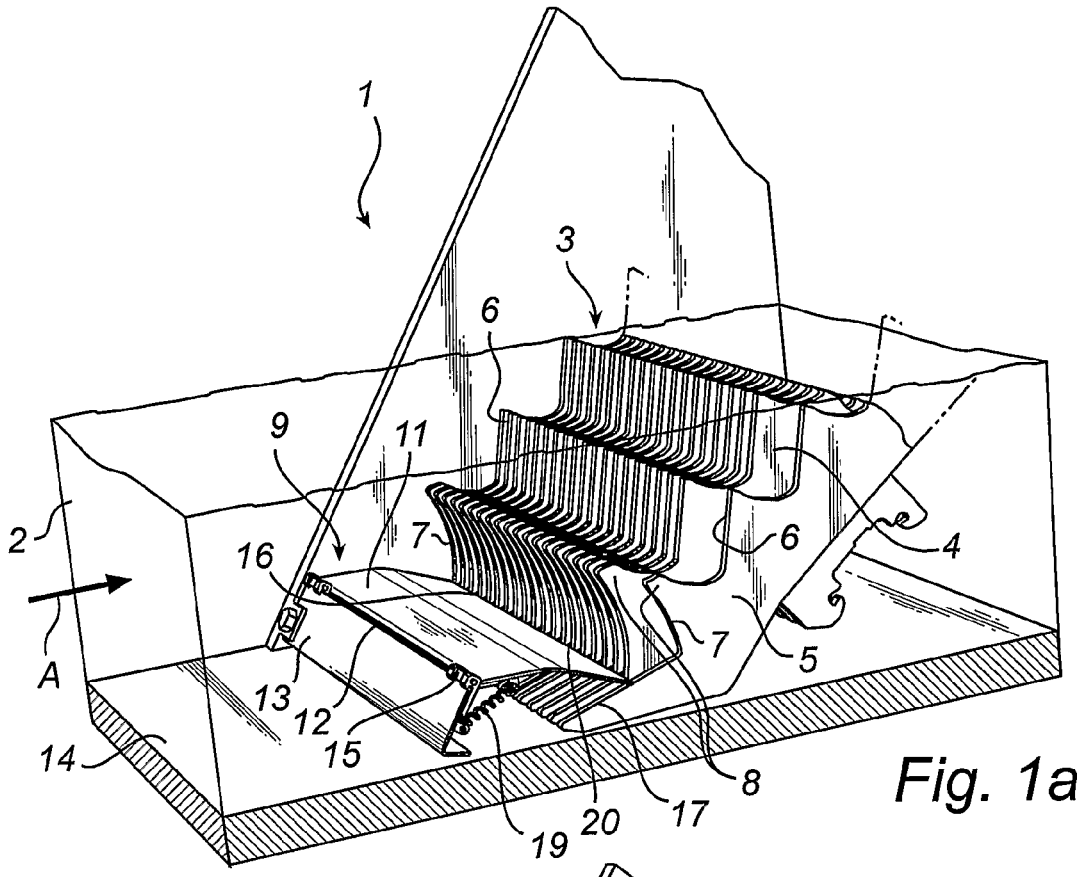
FIGS. 1*a* and 1*b* show schematically in perspective obliquely from the front, and for the sake of clarity with parts broken away, the lower part of a grating of a step screen placed in a gutter with flowing water, and an associated bottom seal in two different maximum positions upwards and downwards.
Figure 1B:
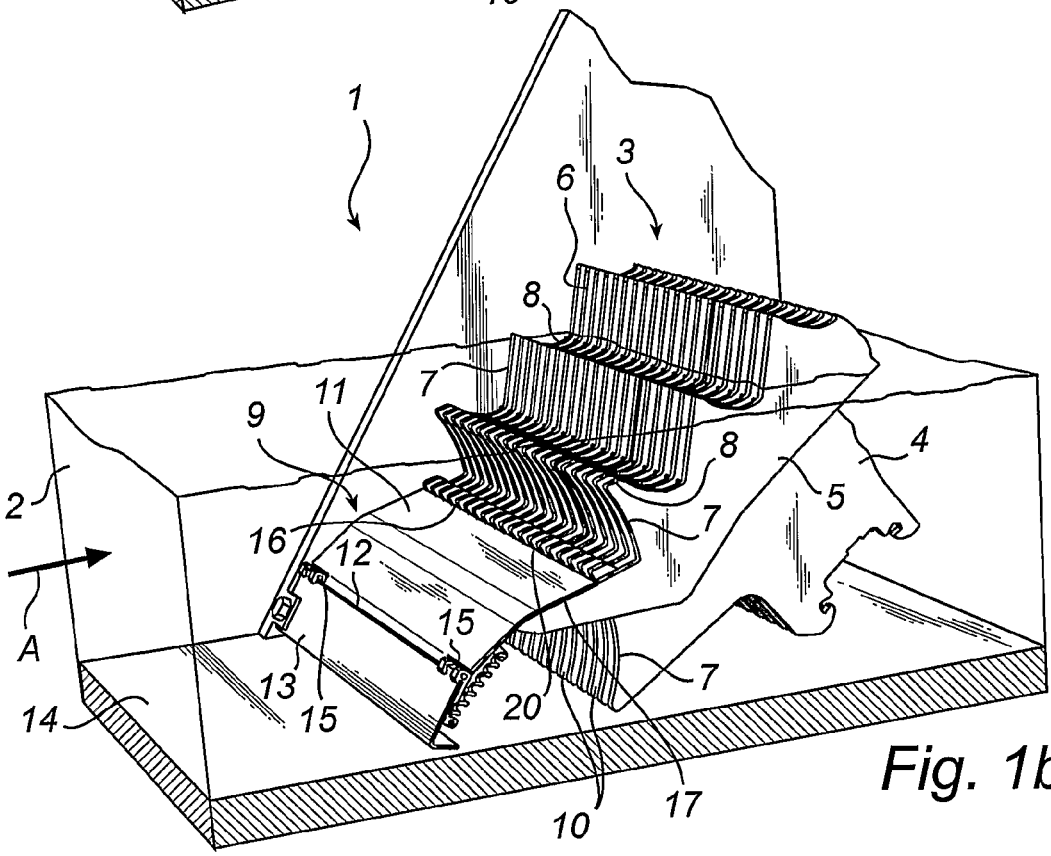
Figure 2A:
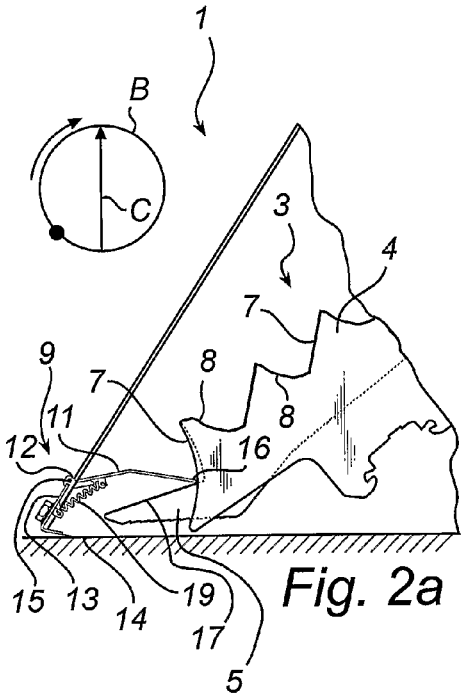
FIGS. 2*a*-2*h* illustrate schematically from the side a complete motion cycle of movable lamellar rods included in the step screen, in relation to fixed lamellar rods and a corresponding motion of the bottom seal.
Figure 2B:
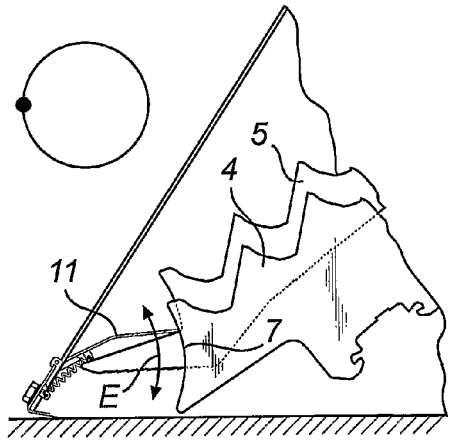
Figure 2C:
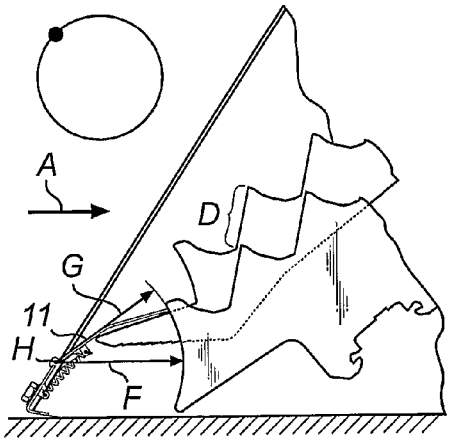
Figure 2D:
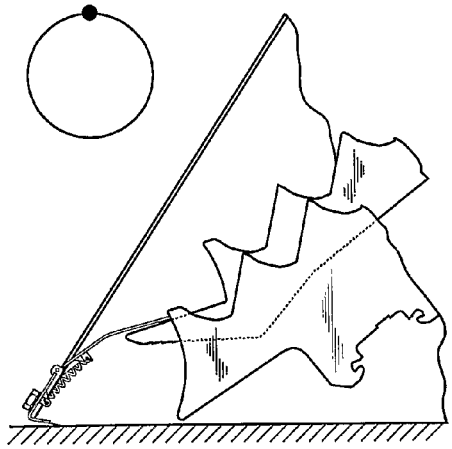
Figure 2E:
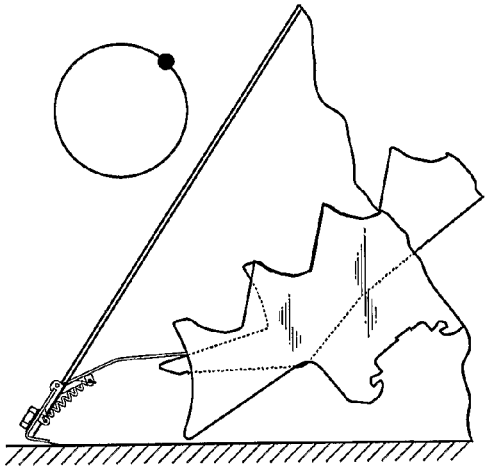
Figure 2F:
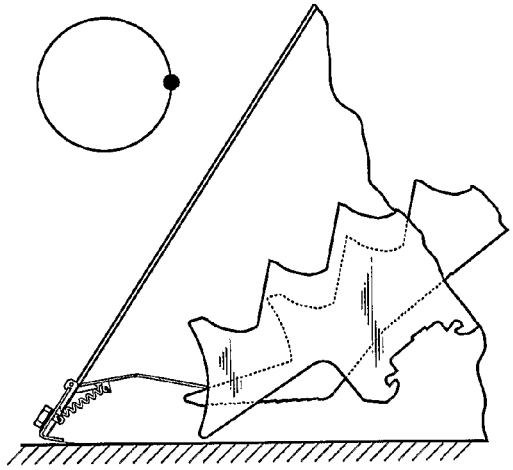
Figure 2G:
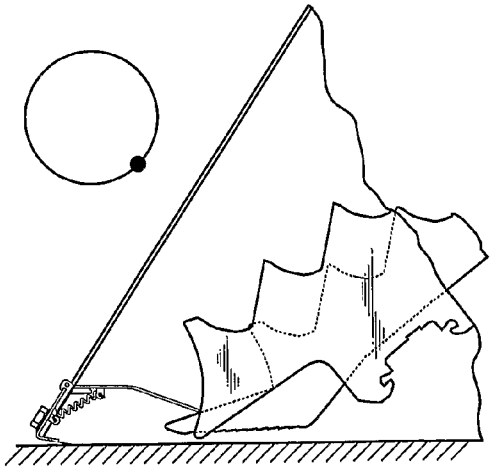
Figure 2H:
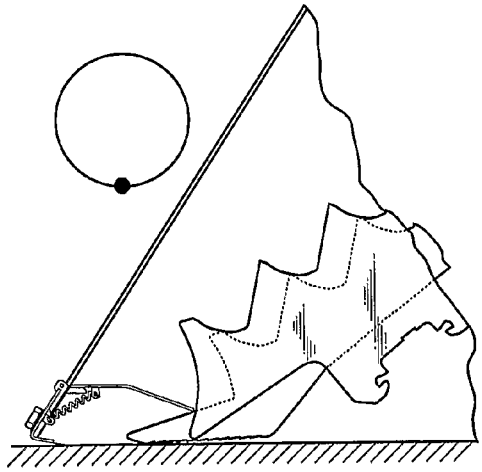

The step screen shown in FIGS. 1*a* and 1*b* and generally designated 1 is adapted to be installed, for instance, in a wastewater treatment plant for separating and conveying solid particles and other objects positioned in flowing water 2 in a gutter (not shown) for continued treatment and/or deposition. The screened water 2 passes, in a manner that will be described below, the step screen for continued purification.

For the separation and conveying of the particles and objects, the step screen 1 comprises a grating 3 which is also only partly shown and which is inclined upwards backwards about 45° in the flow direction A of the water 2. The grating comprises alternately juxtaposed fixed and movable lamellar rods 4 and 5 arranged on end.

The fixed and movable lamellar rods 4, 5 are plane and can, according to the size of the grating and thus the step screen, have a thickness in the order of 2 to 6 mm. The distance in the lateral direction between the fixed and movable lamellar rods 4, 5 can also, according to size, amount to between 1 and 6 mm to form intermediate gaps 6 to allow the screened water 2 to pass through the grating 3.

All lamellar rods 4, 5 have at their edges 7 upstream, i.e. opposite to the direction of flow A, separating and conveying elements in the form of steps 8. The movable lamellar rods 5 are, by means of a driving device (not shown) included in the step screen 1, movable in a closed motion path B, schematically marked in FIGS. 2*a*-2*h*, in their plane with an upward component C which is greater than the height D of the steps 8. This ensures that the solid particles and the objects are effectively separated and conveyed step by step from the water 2 and along the steps 8 of the fixed lamellar rods to an outlet (not shown) for continued treatment.

At the lower end, i.e. the end inserted into the water 2, of the step screen 1 there is a bottom seal generally designated 9. The bottom seal extends substantially across the entire width of the grating 3 to cover and seal the ducts 10 which arise between the fixed lamellar rods 4 at their lowermost step 8, as the movable lamellar rods 5 move upwards from a lower position to an upper (component C) between the fixed lamellar rods 4 along the closed motion path B.

In the preferred embodiment of the bottom seal 9 shown in the drawings, it comprises a bottom cover 11 assembled from one or more parts. This cover is at its longitudinal edge 12 upstream, i.e. opposite to the direction A, pivotally connected to the step screen via a bottom step 13 close to the bottom 14 of the gutter (not shown). The bottom step 13 extends across the entire width of the grating/step screen upstream of the bottom cover 11, which is pivotally connected to the bottom step 13 by means of one or more conventional hinges 15.

Instead of, or supplementing, the hinge/hinges 15 the bottom cover 11 may itself be flexible by being at least partly made of a flexible material.

The bottom cover 11 is at its longitudinal edge 16 downstream guided on guides 17 at the lowermost steps 8 of the movable lamellar rods 5 so as to follow the motion thereof. In this motion, the longitudinal edge of the bottom cover 11 is downstream also pivotable up and down in the direction of arrow E close to and past the edges 7 upstream on the lowermost steps 8 of the fixed lamellar rods 4.

The guides 17 project substantially rectilinearly and in the form of shoulders from the lowermost steps of the movable lamellar rods 5 upstream towards the bottom cover and guide the bottom cover 11 from below by the longitudinal edge 16 of the bottom cover downstream abutting, slidingly at an angle, against the guides of the movable lamellar rods 5.

For optimal covering/sealing of the ducts 10 by means of the bottom cover 11, the edges 7 upstream on the lowermost steps 8 of the fixed lamellar rods 4 are curved with a radius F which is only slightly greater, say about a millimetre, than the pivoting radius G of the bottom cover 11, and which has substantially the same centre H as the latter. As a result, a very small, but substantially tight motion gap 20 is formed between the edges 7 of the fixed lamellar rods 4 upstream and the longitudinal edge 16 of the bottom cover 11 downstream.

To ensure that the bottom cover 11 during the entire motion cycle of the movable lamellar rods 5 along the motion path B is guided by the guides 17 on the movable lamellar rods, the bottom cover 11 is yieldably loaded towards the guides by at least one spring means. In the preferred embodiment, the spring means suitably consists of a tension spring 19 fixed between the bottom step 13 and the bottom cover 11. It is, of course, possible to use, instead of one or more tension springs, torsion springs and/or elastic springs, such as rubber bands.

It goes without saying that the invention should not be considered restricted to the embodiment shown and described but can be modified in an optional manner with-in the scope of protection as claimed in the appended claims.

The invention claimed is:

1. A bottom seal at the lower end of a step screen provided with a grating and adapted to convey solid particles and objects positioned in flowing water, the grating comprising alternately fixed and movable lamellar rods with intermediate gaps to allow the water to pass through the grating and with steps at their longitudinal edges upstream, the movable lamellar rods being movable in a closed motion path in their plane with an upwards component which is greater than the height of the steps, for step by step conveyance of the solid particles and the objects from the water and along the fixed lamellar rods to an outlet, the bottom seal extending substantially across the entire width of the grating to seal the ducts that arise between the fixed lamellar rods at their lowermost step as the movable lamellar rods move upwards between the fixed lamellar rods, the bottom seal comprising:

at least one elongate bottom cover, connected at a longitudinal edge upstream to the step screen and guided at a longitudinal edge downstream on guides on the lowermost steps of the movable lamellar rods to follow the entire motion cycle of the moveable rods and, in the motion, being pivotable up and down close to and past the edges upstream on the lowermost steps of the fixed lamellar rods.

2. A bottom seal as claimed in claim 1, wherein the bottom cover, to be pivotal, is at least partly made of a flexible material.

3. A bottom seal as claimed in claim 2, wherein the guides on the lowermost steps of the movable lamellar rods project from the same upstream towards the bottom cover and guide the bottom cover from below.

4. A bottom seal as claimed in claim 2, wherein the edges upstream on the lowermost steps of the fixed lamellar rods are curved with a radius, only slightly greater than the pivoting radius of the bottom cover, the radius having substantially the same center as the pivoting radius of the bottom cover to form a small, but substantially tight motion gap between the edges of the fixed lamellar rods upstream and the longitudinal edge of the bottom cover downstream.

5. A bottom seal as claimed in claim 2, wherein the bottom cover, to ensure its guiding on the guides of the movable lamellar rods during the motion thereof, is yieldably loaded towards the guides.

6. A bottom seal as claimed in claim 1, wherein the bottom cover is pivotally connected to the step screen via a bottom step, which extends substantially across the entire width of the grating upstream of the bottom cover.

7. A bottom seal as claimed in claim 6, wherein the bottom cover is pivotally connected to the bottom step via at least one hinge.

8. A bottom seal as claimed in claim 7, wherein the guides on the lowermost steps of the movable lamellar rods project from the same upstream towards the bottom cover and guide the bottom cover from below.

9. A bottom seal as claimed in claim 6, wherein the guides on the lowermost steps of the movable lamellar rods project from the same upstream towards the bottom cover and guide the bottom cover from below.

10. A bottom seal as claimed in claim 6, wherein the edges upstream on the lowermost steps of the fixed lamellar rods are curved with a radius, only slightly greater than the pivoting radius of the bottom cover, the radius having substantially the same center as the pivoting radius of the bottom cover to form a small, but substantially tight motion gap between the edges of the fixed lamellar rods upstream and the longitudinal edge of the bottom cover downstream.

11. A bottom seal as claimed in claim 6, wherein the bottom cover, to ensure its guiding on the guides of the movable lamellar rods during the motion thereof, is yieldably loaded towards the guides.

12. A bottom seal as claimed in claim 1, wherein the guides on the lowermost steps of the movable lamellar rods project from the same upstream towards the bottom cover and guide the bottom cover from below.

13. A bottom seal as claimed in claim 12, wherein the longitudinal edge of the bottom cover downstream abuts slidingly against the guides of the movable lamellar rods.

14. A bottom seal as claimed in claim 13, wherein the guides of the movable lamellar rods are substantially rectilinear.

15. A bottom seal as claimed in claim 12, wherein the guides of the movable lamellar rods are substantially rectilinear.

16. A bottom seal as claimed in claim 1, wherein the edges upstream on the lowermost steps of the fixed lamellar rods are curved with a radius, only slightly greater than the pivoting radius of the bottom cover, the radius having substantially the same center as the pivoting radius of the bottom cover to form a small, but substantially tight motion gap between the edges of the fixed lamellar rods upstream and the longitudinal edge of the bottom cover downstream.

17. A bottom seal as claimed in claim 1, wherein the bottom cover, to ensure its guiding on the guides of the movable lamellar rods during the motion thereof, is yieldably loaded towards the guides.

18. A bottom seal as claimed in claim 17, wherein the yieldable load is provided by at least one spring.

19. A bottom seal as claimed in claim 17, wherein the yieldable load is provided by at least one tension spring fixed between the bottom step and the bottom cover.

* * * * *